US008262310B2

(12) United States Patent
Sikorski et al.

(10) Patent No.: US 8,262,310 B2
(45) Date of Patent: Sep. 11, 2012

(54) COUPLER WITH SECONDARY LOCK ON FRONT HOOK

(75) Inventors: Robert Sikorski, Stow, OH (US); Shadruz Daraie, Fairlawn, OH (US)

(73) Assignee: Paladin Brands Group, Inc., Cedar Rapids, IA (US)

( * ) Notice: Subject to any disclaimer, the term of this patent is extended or adjusted under 35 U.S.C. 154(b) by 216 days.

(21) Appl. No.: 12/622,921

(22) Filed: Nov. 20, 2009

(65) Prior Publication Data

US 2010/0124453 A1 May 20, 2010

Related U.S. Application Data

(60) Provisional application No. 61/116,491, filed on Nov. 20, 2008.

(51) Int. Cl.
*E02F 3/96* (2006.01)

(52) U.S. Cl. ..... 403/322.3; 37/468; 414/723

(58) Field of Classification Search ..... 414/723; 37/468; 403/322.3, 322.4
See application file for complete search history.

(56) References Cited

U.S. PATENT DOCUMENTS

| | | | | |
|---|---|---|---|---|
| 3,961,812 | A * | 6/1976 | Von Allworden | 172/275 |
| 5,179,794 | A * | 1/1993 | Ballinger | 37/468 |
| 5,549,440 | A | 8/1996 | Cholakon et al. | |
| 5,692,325 | A | 12/1997 | Kuzutani | |
| 5,890,871 | A | 4/1999 | Woerman | |
| 6,132,131 | A | 10/2000 | Nakamura et al. | |
| 6,422,805 | B1 | 7/2002 | Miller | |
| 6,431,785 | B1 | 8/2002 | Melander | |
| 6,481,124 | B1 * | 11/2002 | Miller et al. | 37/468 |
| 6,508,616 | B2 * | 1/2003 | Hung | 414/723 |
| 6,691,438 | B2 | 2/2004 | Fatemi | |

(Continued)

FOREIGN PATENT DOCUMENTS

WO WO 2008/029112 3/2008

OTHER PUBLICATIONS

Notification of Related (U.S. Appl. No. 13/072,098).

(Continued)

*Primary Examiner* — Joshua Kennedy
(74) *Attorney, Agent, or Firm* — Fay Sharpe LLP

(57) ABSTRACT

A coupler includes a frame with a front hook and a rear hook. A rear hook lock moves between an unlocked position and a locked position, wherein the rear hook lock obstructs an open mouth of the rear hook when the rear hook lock is in its locked position. An actuator is connected to the frame and is operatively connected to the rear hook lock. The actuator is adapted to move the rear hook lock between its unlocked and locked positions. A secondary lock includes a latch that moves between extended and retracted positions, wherein the latch obstructs an open mouth of the front hook when the latch is in its extended position. A first lock bar is connected to the frame and is movable between: (i) a disengaged position in which the first lock bar allows movement of the rear hook lock to its unlocked position and allows movement of said latch to its retracted position; and, (ii) an engaged position where the first lock bar blocks movement of the rear hook lock to its unlocked position and blocks movement of the latch to its retracted position. The first lock bar is biased toward its engaged position and is adapted to be moved to its disengaged position by contact with an associated excavator arm.

15 Claims, 9 Drawing Sheets

U.S. PATENT DOCUMENTS

| | | | | |
|---|---|---|---|---|
| 6,699,001 | B2 | 3/2004 | Fatemi | |
| 6,881,002 | B2 | 4/2005 | Fatemi | |
| 6,902,346 | B2 | 6/2005 | Steig, Jr. et al. | |
| 6,962,475 | B2 | 11/2005 | Fatemi | |
| 6,964,122 | B2 | 11/2005 | Cunningham et al. | |
| 7,306,395 | B2 | 12/2007 | Fatemi | |
| 7,426,796 | B2 | 9/2008 | Cunningham et al. | |
| 7,493,712 | B2 * | 2/2009 | McCormick et al. | 37/468 |
| 7,648,305 | B2 | 1/2010 | Beales | |
| 7,984,575 | B2 * | 7/2011 | Robl et al. | 37/468 |
| 2002/0071754 | A1 * | 6/2002 | Fatemi | 414/723 |
| 2007/0157492 | A1 | 7/2007 | Miller et al. | |
| 2007/0166143 | A1 | 7/2007 | Hart et al. | |
| 2008/0067784 | A1 | 3/2008 | Calvert et al. | |
| 2008/0193210 | A1 * | 8/2008 | Beales | 403/326 |
| 2009/0249661 | A1 * | 10/2009 | Daraie et al. | 37/468 |
| 2009/0282712 | A1 * | 11/2009 | Pruszynski | 37/468 |
| 2010/0031539 | A1 * | 2/2010 | Daraie et al. | 37/468 |
| 2010/0061799 | A1 * | 3/2010 | Hill | 403/322.3 |
| 2010/0067982 | A1 * | 3/2010 | Hill | 403/321 |
| 2010/0107456 | A1 * | 5/2010 | Miller et al. | 37/468 |
| 2010/0192425 | A1 * | 8/2010 | Miller et al. | 37/468 |
| 2010/0232920 | A1 * | 9/2010 | Calvert et al. | 414/723 |

OTHER PUBLICATIONS

International Search Report mailed Jan. 21, 2010 for International application No. PCT/US09/65346.

Written Opinion mailed Jan. 21, 2010 for International application No. PCT/US09/65346.

International Preliminary Report on Patentability mailed Jun. 3, 2011 for International application No. PCT/US2009/065346.

* cited by examiner

COUPLER WITH SECONDARY LOCK ON FRONT HOOK

CROSS-REFERENCE TO RELATED APPLICATION

This application claims priority from and benefit of the filing date of U.S. provisional application Ser. No. 61/116,491 filed Nov. 20, 2008, and said provisional application is hereby expressly incorporated by reference into the present specification.

BACKGROUND

Couplers are known for securing construction attachments, such as buckets, impact hammers, shears, etc., fixedly and operatively to both an arm (or "dipper-stick") and a control link of a tractor, backhoe, excavator or other type of construction/agricultural machine (the term "excavator" as used herein is intended to encompass an excavator, tractor, backhoe, and/or other machine having an arm and a control link). As is generally well known, these couplers are used as an alternative to a pin-on connection for operatively securing an attachment to the arm and control link. The control link is used to pivot the coupler (and any attachment coupled thereto) relative to the arm. The coupler includes a lock system for releasably engaging and retaining first and second parallel attachment pins that are secured to the attachment.

SUMMARY

An attachment coupler includes a frame with: (i) an upper portion adapted for connection to an excavator arm and control link; and, (ii) a lower portion including a front hook and rear hook respectively adapted for engaging first and second associated attachment pins of an associated attachment. A lock plate moves between an unlocked position and a locked position, wherein the lock plate obstructs the rear hook to capture the second associated attachment pin in the rear hook when in the locked position and wherein the lock plate is withdrawn relative to the rear hook to allow movement of the second associated attachment pin into and out of the rear hook when in the unlocked position. An actuator is operably connected to the lock plate for moving the lock plate to and between its unlocked position and its locked position. A first lock bar is connected to the frame and is movable between an engaged position and a disengaged position, wherein the first lock bar blocks movement of the lock plate from its locked position to its unlocked position when the first lock bar is in its engaged position. A secondary lock is associated with said front hook and includes a latch that moves between an extended position and a retracted position. The latch includes at least a first latch projection that projects into and obstructs the front hook to capture the first associated attachment pin in the front hook when the latch is in its extended position. The first latch projection is retracted relative to the front hook to allow movement of the first associated attachment pin into and out of the front hook when the latch is in the retracted position. The latch is biased to its extended position and is movable from its extended position to its retracted position by contact between the latch and the first associated attachment pin when the first lock bar is in its disengaged position. The first lock bar blocks movement of the latch from its extended position to its retracted position when the first lock bar is in its engaged position.

A coupler includes a frame with a front hook and a rear hook. A rear hook lock moves between an unlocked position and a locked position, wherein the rear hook lock obstructs an open mouth of the rear hook when the rear hook lock is in its locked position. An actuator is connected to the frame and is operatively connected to the rear hook lock. The actuator is adapted to move the rear hook lock between its unlocked and locked positions. A secondary lock comprising a latch moves between extended and retracted positions, wherein the latch obstructs an open mouth of the front hook when the latch is in its extended position. A first lock bar is connected to the frame and is movable between an engaged position and a disengaged position. The first lock bar includes: (i) a first lock face that blocks movement of the rear hook lock from its locked position to its unlocked position when said first lock bar is in its engaged position; and, (ii) a second lock face that blocks movement of the latch of the secondary lock from its extended position to its retracted position when the first lock bar is in its engaged position. The first lock bar is biased toward its engaged position and adapted to be moved to its disengaged position by relative movement between the frame and an associated arm to which the frame is connected sufficient to cause a projecting end of the first lock bar to contact the associated arm.

A coupler includes a frame with a front hook and a rear hook. A rear hook lock moves between an unlocked position and a locked position, wherein the rear hook lock obstructs an open mouth of the rear hook when the rear hook lock is in its locked position. An actuator is connected to the frame and is operatively connected to the rear hook lock. The actuator is adapted to move the rear hook lock between its unlocked and locked positions. A secondary lock includes a latch that moves between extended and retracted positions, wherein the latch obstructs an open mouth of the front hook when the latch is in its extended position. A first lock bar is connected to the frame and is movable between: (i) a disengaged position in which the first lock bar allows movement of the rear hook lock to its unlocked position and allows movement of said latch to its retracted position; and, (ii) an engaged position where the first lock bar blocks movement of the rear hook lock to its unlocked position and blocks movement of the latch to its retracted position. The first lock bar is biased toward its engaged position and is adapted to be moved to its disengaged position by contact with an associated excavator arm.

DETAILED DESCRIPTION

Figure 6:
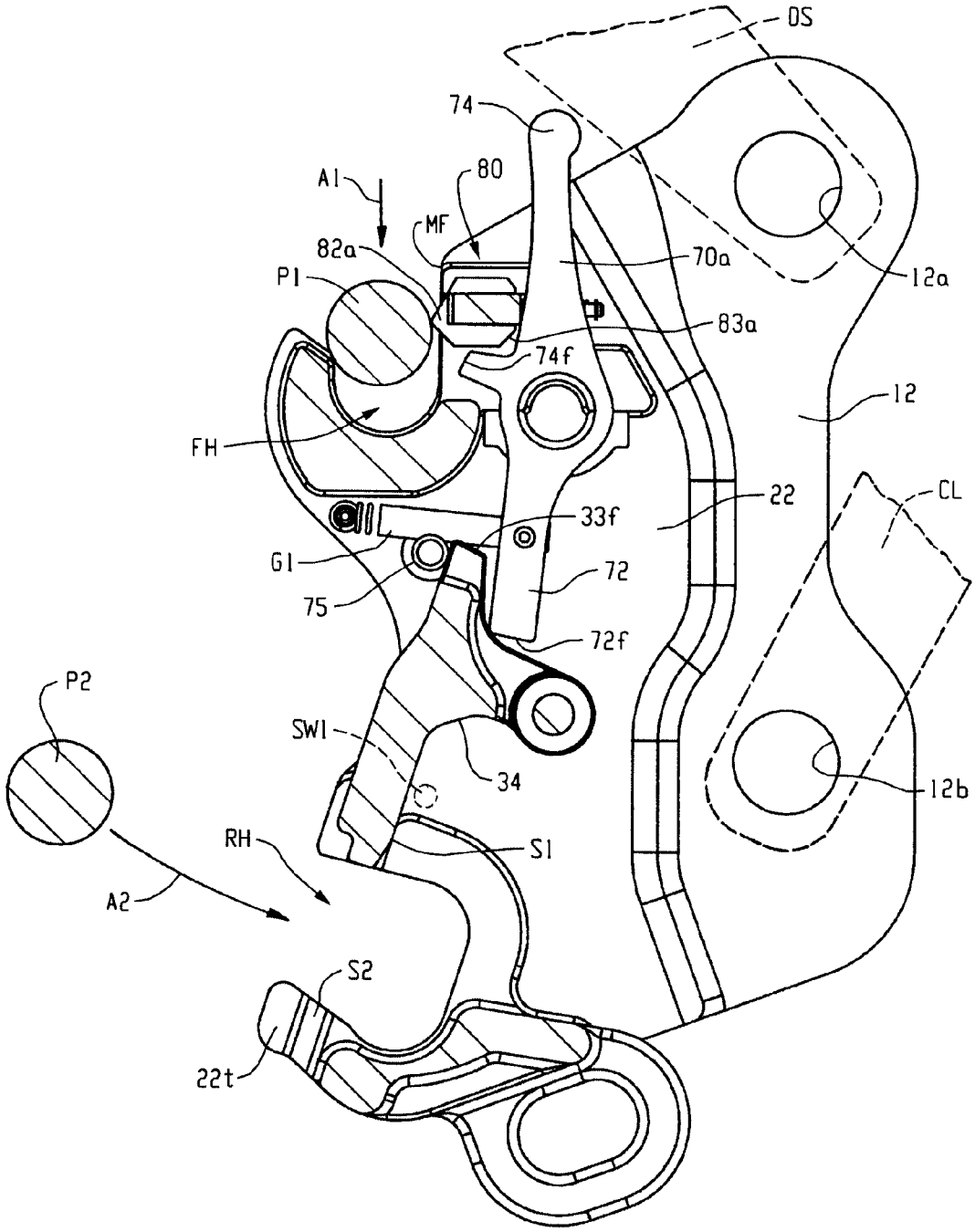
FIG. 6 is a sectional view taken at view line 6-6 of FIG. 3 with the hydraulic cylinder actuator removed and showing the coupler 10 operatively connected to an excavator, with the coupler in its unlocked state and partially coupled with first and second attachment pins P1,P2.
Figure 7:
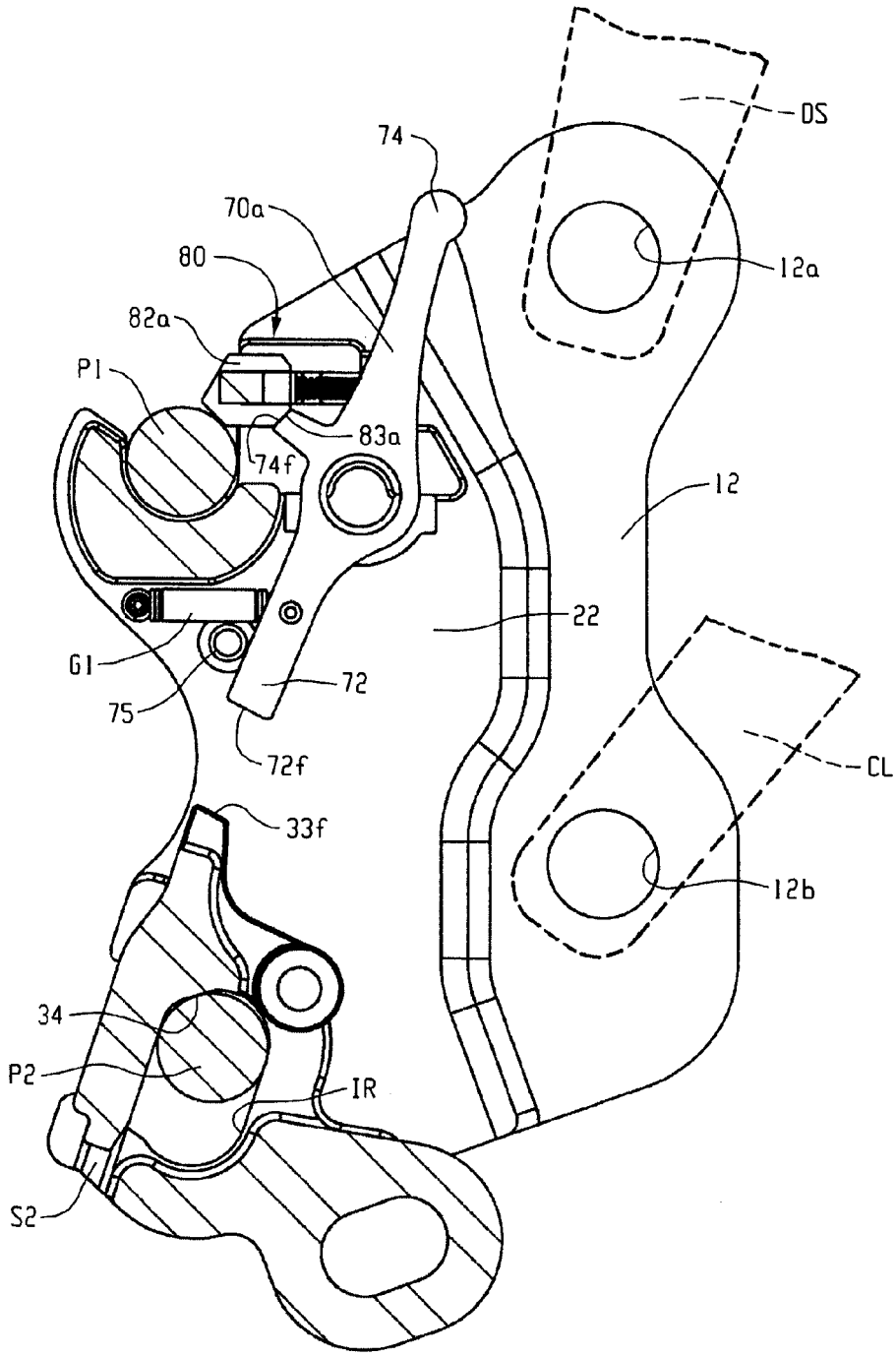
FIG. 7 is similar to FIG. 6 but shows the coupler in its locked state and operatively coupled with first and second attachment pins P1,P2.

The coupler 10 is adapted for operative pivoting connection to an excavator, backhoe, or like machine (generally referred to herein as an "excavator") having a boom or arm or "dipper stick" DS and a control link CL as shown in FIGS. 6 and 7. When operatively connected to an excavator, the coupler 10 is adapted for selectively coupling with a construction attachment (e.g., a bucket, blade, shear, hammer, etc.) including first and second parallel spaced apart attachment pins P1,P2 (the first and second attachment pins are shown FIGS. 6 & 7).

Referring to FIGS. 1-4, the coupler 10 comprises a frame F comprising an upper portion U adapted to be secured to the associated excavator, and a lower portion L adapted to be releasably coupled to the bucket or other attachment having the first and second parallel, spaced-apart attachment pins P1,P2. The upper portion U comprises first and second parallel, spaced-part upper ribs 12,14 comprising respective first and second apertures 12*a*,12*b* (for the first upper rib 12) and 14*a*,14*b* (for the second upper rib 14). The first apertures 12*a*,14*a* are aligned with each other along a first pin-on axis X1 and the second apertures 12*b*,14*b* are aligned with each other along a second pin-on axis X2. The coupler 10 is adapted to receive the arm DS and control link CL of an associated excavator in the channel defined between the upper ribs 12,14, with the excavator arm DS pivotally secured to the coupler 10 by a first pin received through the excavator arm and the aligned first apertures 12*a*,14*a*, and with the excavator control link CL pivotally secured to the coupler 10 by a second pin received through the excavator control link and the aligned second apertures 12*b*,14*b*, to secure the coupler 10 operatively to the excavator. The upper ribs 12 and 14 can be one-piece or multi-piece and are constructed using steel such as steel plates or castings or the like.

The lower portion L comprises first and second lower ribs 22,24 that are respectively secured to the first and second upper ribs 12,14. The upper ribs 12,14 can alternatively be defined together with the lower ribs 22,24, respectively, as a one-piece casting or other one-piece structure if desired. The first and second lower ribs 22,24 comprise respective first and second open recesses 22*a*,22*b* (for the first lower rib 22) and 24*a*,24*b* (for the second lower rib 24). The first recesses 22*a*,24*a* are aligned with each other, and the second recesses 22*b*,24*b* are aligned with each other so that first recesses 22*a*,22*b* cooperate to define a first or front hook FH adapted to receive the first associated attachment pin P1 (FIGS. 6 & 7) and the second recesses 22*b*,24*b* cooperate to define a second or rear hook RH adapted to receive the second associated attachment pin P2 (FIGS. 6 & 7). As shown, one or more first hook plates 23*a* preferably extend between and interconnect the first and second lower ribs 22,24 in the region of the first recesses 22*a*,24*a* and further define the front hook FH. Likewise, one or more second hook plates 23*b* preferably extend between and interconnect the first and second lower ribs 22,24 in the region of the second recesses 22*b*,24*b* and further define the rear hook RH. The lower ribs 22,24 can each be one-piece or multi-piece steel plates, castings or the like. The illustrated frame F includes an optional lift eye 26 welded or otherwise connected thereto of formed as a part thereof. The frame F and the other coupler components described below are defined from suitable metals, e.g., steel alloys, unless otherwise specified.

Figure 1:
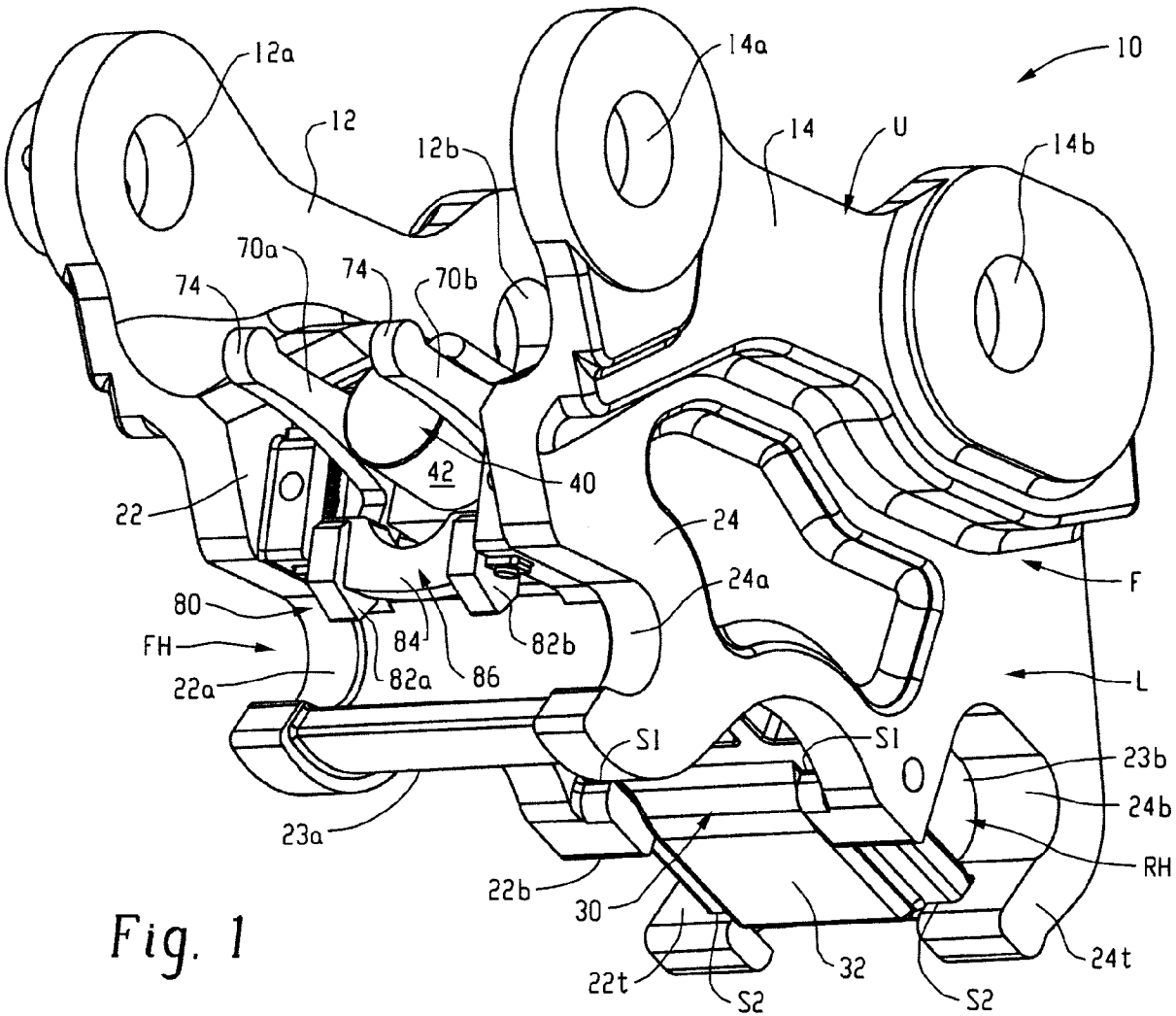
FIG. 1 is an isometric view of a coupler 10 formed in accordance with one embodiment of the present development.
Figure 2:
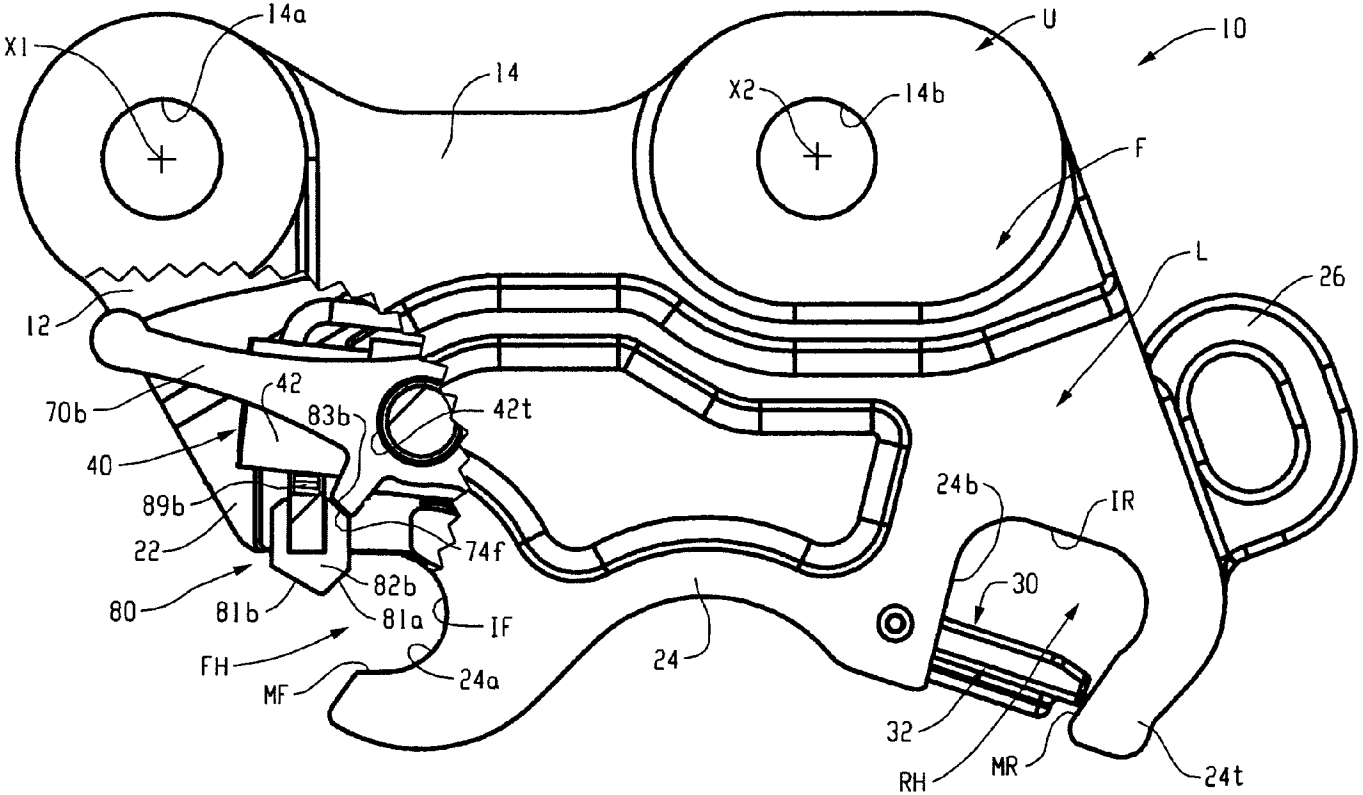
FIG. 2 is a side view of the coupler 10 (partially broken away)
Figure 3:
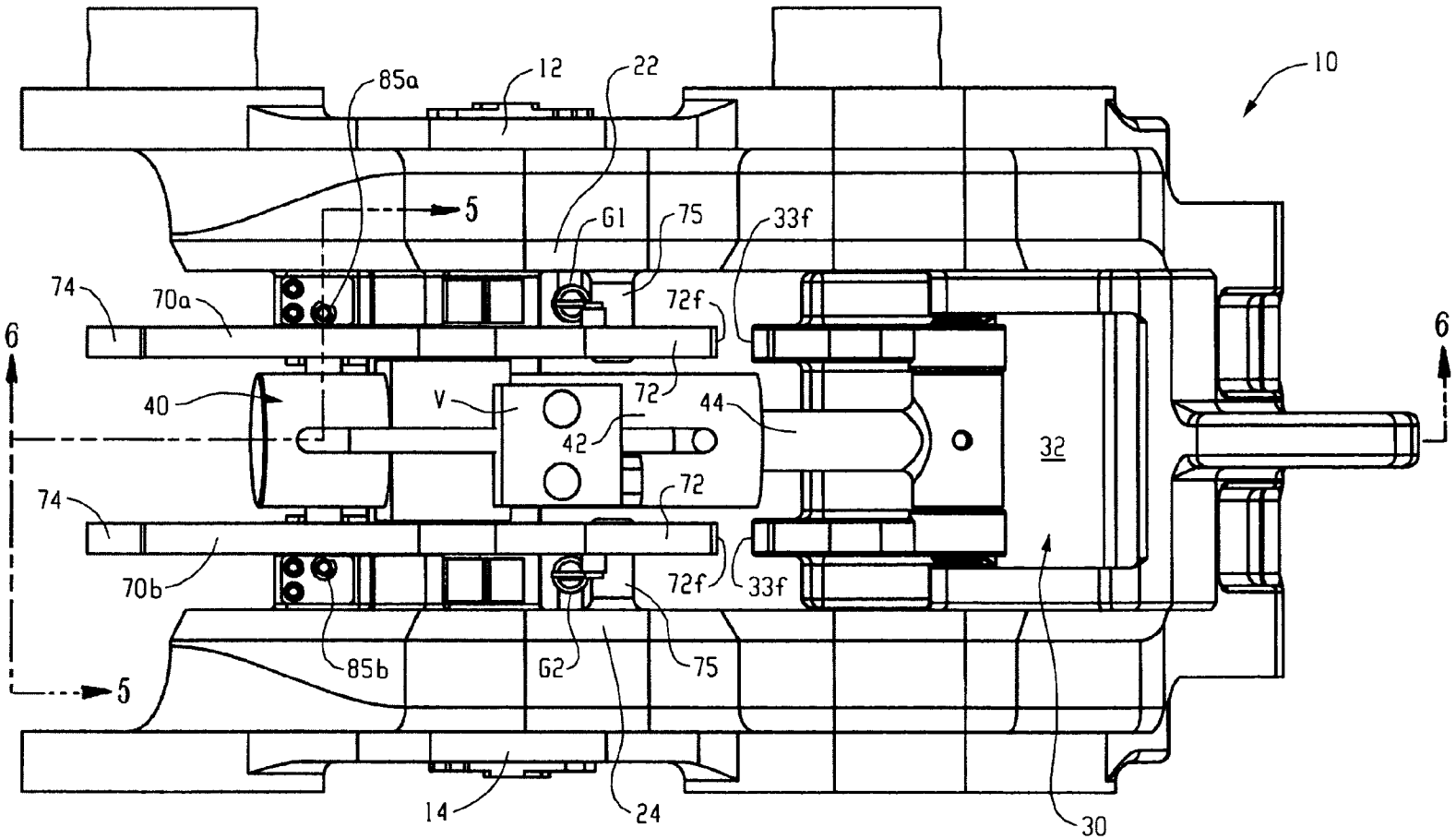
FIG. 3 is a top view of the coupler 10.

With specific reference to FIG. 2, the front hook FH includes an open mouth MF and a closed inner region IF, with the open mouth MF oriented in a first or forward direction facing away from the rear hook RH, generally parallel with a reference line that extends between the first and second pin-on axes X1,X2. The rear hook RH includes an open mouth MR and a closed inner region IR. The open mouth MR of the rear hook RH is oriented downwardly (away from the upper portion U) and transversely relative to the open mouth MF of the front hook FH (and transversely relative to the reference line that extends between the first and second pin-on axes X1,X2). As is generally known in the art, this relative transverse arrangement of the mouth MR of the rear hook RH relative to the mouth MF of the front hook FH ensures that the first attachment pin P1 must be received in the front hook FH before the second attachment pin P2 can be received in the rear hook RH by rotation of the frame about the first attachment pin P1 during attachment coupling, and conversely ensures that during decoupling, the second attachment pin P2 must be withdrawn from the rear hook RH by rotation of the coupler frame F about the first attachment pin P1 before the first attachment pin P1 can be withdrawn from the front hook FH.

The coupler 10 further comprises a rear hook lock or lock plate 30 located between the first and second lower ribs 22,24 and movable relative to lower ribs 22,24 between an unlocked or retracted position (FIG. 6) where it is located so not to block (i.e., to open) the mouth MR of the rear hook RH to allow insertion and withdrawal of the second attachment pin P2, and a locked or extended position (FIG. 7) where it obstructs or blocks (i.e. closes) the mouth MR and captures the second attachment pin P2 in the rear hook RH.

The rear lock plate 30, which can be a one or multi-piece construction, comprises a lock body 32 that is slidably connected to the frame F. In particular, the lower ribs 22,24 of the frame F each define inner and outer slots S1,S2 located on opposite sides of the mouth MR of the rear hook RH, with the inner slots S1 located on an inner side of the mouth MR (closer to the front hook FH) and with the outer slots S2 located on an opposite outer side of the mouth MR. The outer slots S2 are defined in respective outer tips 22*t*,24*t* of the first and second lower plates 22,24. The lock body 32 is slidably supported by the opposing inner slots S1 and is movable in the slots S1 from a retracted position (FIG. 6) for the retracted/unlocked position of the rear lock plate 30 where the mouth MR of the rear hook RH is open sufficiently to receive (or release) the second attachment pin P2 into (or out of) the rear hook RH, and an extended position (FIG. 7) for the extended/locked position of the rear lock plate 30 where the lock body 32 at least obstructs and preferably completely spans the mouth MR and extends into the opposing outer slots S2 so as to be supported in both the inner slots S1 on one side of the mouth MR and the outer slots S2 on an opposite side of the mouth MR. FIG. 2 illustrates an intermediate position of the lock plate 30 between the extended/locked position and the retracted/unlocked position, because in FIG. 2, the lock body 32 obstructs but does not completely span the mouth MR so as to be engaged with the outer slots S2 in the tips 22*t*,24*t* of the lower plates 22,24. In an alternative embodiment, the intermediate position shown in FIG. 2 is deemed to be the extended/locked position of the rear lock plate 30 because the lock body 32 obstructs the mouth MR sufficiently to capture an associated second attachment pin P2 in the rear hook RH.

With specific reference to FIG. 7, the position of the lock plate 30 in the locked position and the location of the second attachment pin P2 in the rear hook RH will vary depending upon the pin spacing between the first and second attachment pins P1,P2. FIG. 7 shows the shortest possible pin spacing between the first and second attachment pins P1,P2 that can be engaged by the coupler 10. In the illustrated embodiment, the body 32 of the lock plate 30 will completely span the mouth MR of the rear hook RH and be supported on the opposite sides thereof in the opposing inner slots S1 and the opposing outer slots S2 for all spacings of the attachment pins P1,P2 able to be mated with the coupler 10. Also, a cam portion 34 of the lock plate 30 will be in contact with the second attachment pin P2 for all locked positions of the lock plate 30, without regard to the spacing of the attachment pins P1,P2, so that the lock plate 30 will urge and maintain the second attachment pin P2 in abutment with the inner region IR of the rear hook RH.

Figure 4:
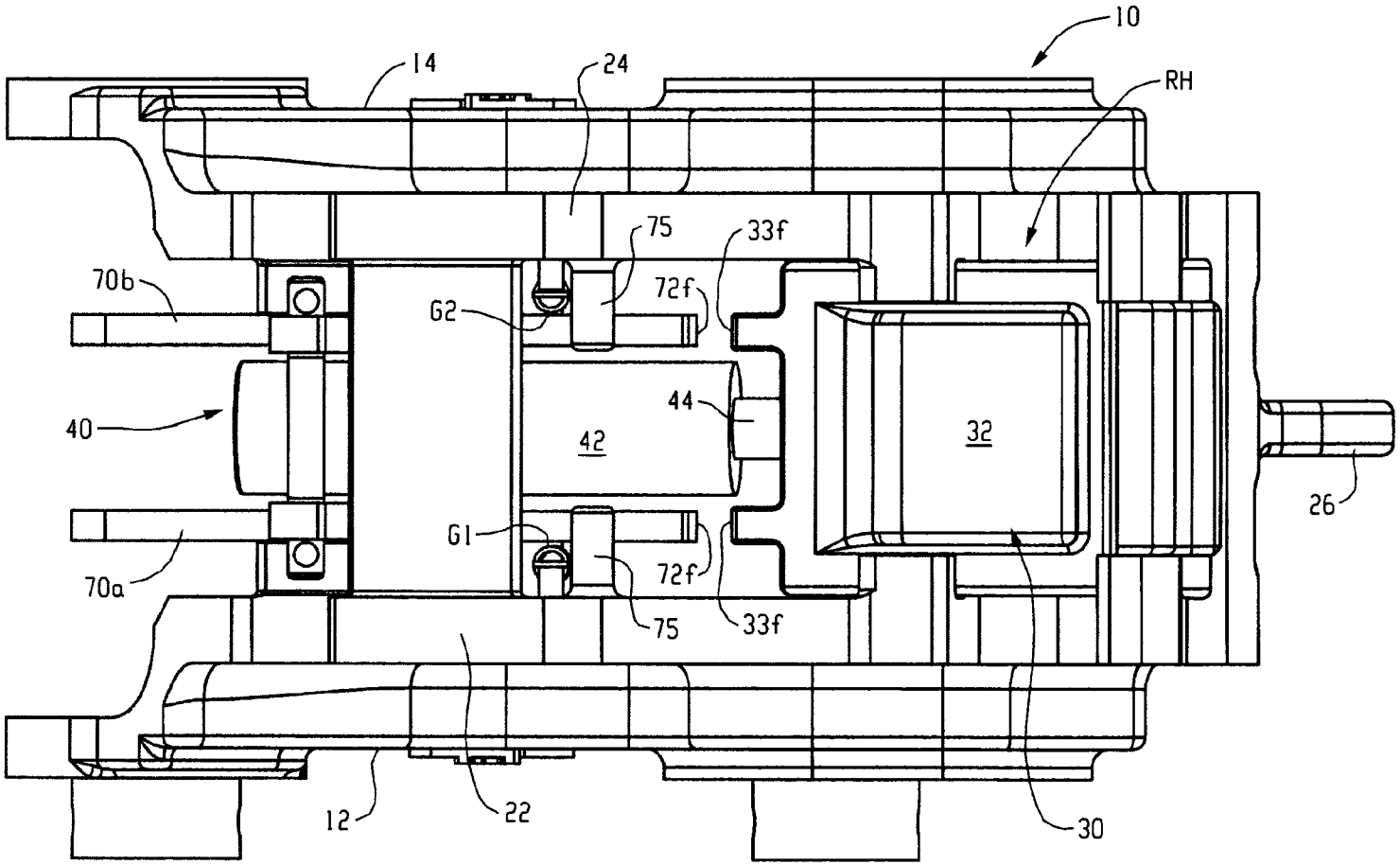
FIG. 4 is a bottom view of the coupler 10.
Figure 8:
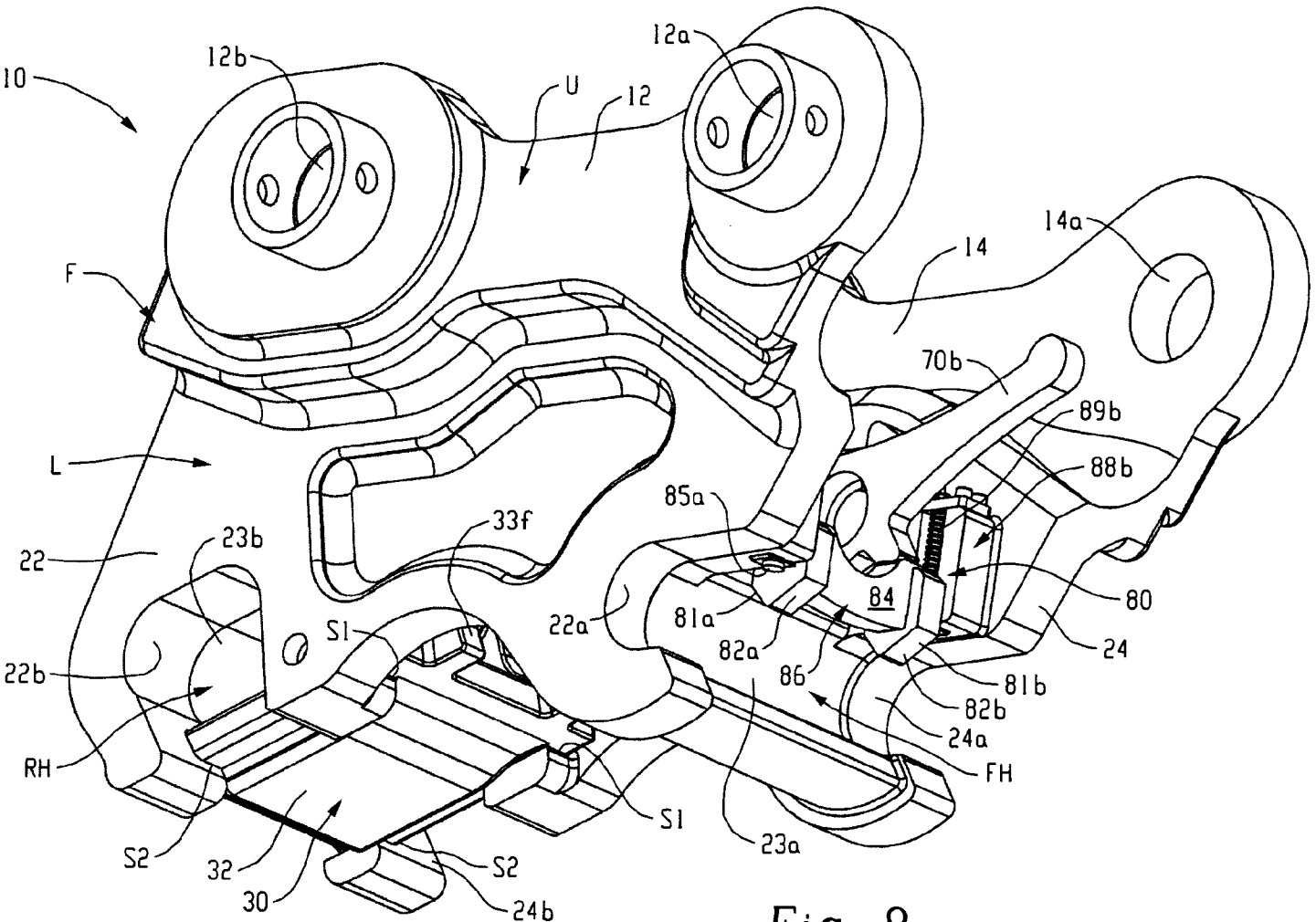
FIG. 8 is an isometric view similar to FIG. 1 but showing a coupler 100 which is an alternative embodiment to the coupler 10.

As can be seen in FIG. 4, the coupler 10 further comprises an actuator 40 operatively connected between the frame F and the rear lock plate 30 and adapted to move the lock plate 30 selectively to and between its extended/locked and retracted/unlocked positions and to hold the lock plate 30 in either the locked or unlocked position (note that the actuator 40 is not shown in FIGS. 6-8 to make the drawings more easily understood). In the illustrated embodiment, the actuator 40 comprises a hydraulic cylinder having a body 42 anchored to the frame F, e.g., using a trunnion or other mount between the lower ribs 22,24. The hydraulic cylinder further comprises a rod 44 operatively coupled to the lock plate 30 and selectively extensible and retractable relative to the cylinder body 42. The cylinder body 42 is pressurized to extend or retract the rod 44 with hydraulic fluid supplied from the hydraulic system of the associated excavator through extend and retract ports, respectively.

The coupler 10 further comprises at least one supplemental lock arm/bar that selectively blocks movement of the lock plate 30 from its extended/locked position to its retracted/unlocked position. As shown, the coupler 10 comprises first and second lock arms/bars 70*a*,70*b* located respectively adjacent the first and second lower ribs 22,24. Each lock bar 70*a*,70*b* is pivotally or otherwise movably connected relative to the coupler frame F, e.g., as shown by being pivotally mounted on the trunnions 42*t* of the cylinder body 42 (see FIG. 5 in which only the lock bar 70*b* is shown). The lock bars 70*a*,70*b* move between an up or disengaged position (FIG. 6) and a down or engaged position (FIG. 7). When at least one of the lock bars 70*a*,70*b* is in its engaged position, the one or more lock bars 70*a*,70*b* block movement of the lock plate 30 from its locked position to its unlocked position (although the lock plate 30 can move from its locked position partially toward its unlocked position even when one or both lock bars 70*a*,70*b* are in their locked positions as shown in FIG. 2). When all lock bars 70*a*,70*b* are in the disengaged position, they are located so as not to block movement of the lock plate 30 from its locked position to its unlocked position. The coupler 10 comprises first and second lock bar stops 75 (FIGS. 3 & 4) connected to first and second lower ribs 22,24 or other location of the frame F. The first and second lock bars 70*a*,70*b* respectively abut the first and second stops 75 to define the engaged position of the lock bars 70*a*,70*b*. The lock bars 70*a*,70*b* are spring-biased into the engaged position against the respective stops 75. As shown, the coupler 10 comprises first and second lock bar springs, such as coiled tension springs G1,G2, respectively connected between the first and second lock bars 70*a*,70*b* and first and second anchor points on the frame F (a torsion spring mounted coaxially about each lock bar pivot axis can alternatively/additionally be used).

Each lock bar 70*a*,70*b* comprises a first end 72 including a first lock face 72*f* and an opposite, second end 74. The lock bars 70*a*,70*b* are pivotally connected to the coupler frame F between their first and second ends 72,74. The second ends 74 of the lock bars 70*a*,70*b* project outwardly from the coupler frame F in the region between the first hook FH and the first apertures 12*a*,14*a* of the upper portion U. The first ends 72 of the lock bars are located between the lower ribs 22,24 and, as described further below, the first lock faces 72*f* thereof selectively engage respective lock faces 33*f* of the lock plate 30 to block movement of the lock plate 30 from its locked position to its unlocked position when the lock bars 70*a*,70*b* are in the engaged position.

FIGS. 6 and 7 illustrate operation of the first and second lock bars 70*a*,70*b* with reference to the lock bar 70*a*. The lock bar 70*b* is structured and functions in a corresponding manner. FIG. 7 shows the coupler 10 with the lock plate 30 in a locked position such that the first and second attachment pins P1,P2 are operatively engaged with the coupler. The lock bar 70*a* is held in its engaged position against stop 75 by spring G1. If the hydraulic cylinder or other actuator 40 (not shown in FIGS. 6 and 7) fails or is operated to retract the lock plate 30 from its locked position toward its unlocked position, the lock face 33*f* of the lock plate 30 will abut the first lock face 72*f* of the lock bar 70*a* and the lock plate 30 will be blocked from any further movement toward its unlocked position so that the lock plate 30 at least partially blocks the mouth MR of the rear hook RH to prevent escape of the second attachment pin P2 from the rear hook RH. The abutting lock faces 33*f*,72*f* are shaped and arranged so that the lock plate 30 will not move the lock bar 70*a* toward its disengaged position upon contact therewith. If the coupler 10 is rotated relative to excavator arm DS to its curled or crowded position as shown FIG. 6, the outer end 74 of lock bar 70*a* contacts the excavator arm DS so that the lock bar is pivoted to its disengaged position against the biasing force of spring G1 so that the first lock face 72*f* is moved to a position where it does not obstruct movement of the lock plate 30 to its unlocked position where the second attachment pin P2 can move freely out of (and into) the rear hook RH. As is further apparent in FIG. 6, when the coupler 10 is pivoted away from the curled or crowded position, the lock plate 30 blocks return of the lock bar 70*a* to its engaged position under force of the spring G1 until the lock plate 30 is moved from its unlocked to its locked position. The lock bar 70*b* functions in the same manner as described for the lock bar 70*a*. When both lock bars 70*a*,70*b* are included in the coupler 10, the respective outer ends 74 thereof (which can be tied together by a cross-pin or the like) contact the excavator arm DS when the coupler is curled/crowded so that both lock bars 70*a*,70*b* will be pivoted to their respective disengaged positions to allow movement of the lock plate 30 to its unlocked position. FIG. 8 shows a coupler 10 with only a single lock bar 70*b* (the actuator 40 is not shown in FIG. 8).

The coupler 10 further comprises a secondary lock 80 associated with the front hook FH to prevent undesired escape of the first attachment pin P1 from the front hook FH. The secondary lock 80 comprises a latch 86 operatively connected to the coupler frame F and adapted to move between an extended position (see FIGS. 2 and 7) and a retracted position (FIG. 6). In the illustrated embodiment, the latch 86 comprises a latch bar 84 including at least one and preferably first and second latch projections 82*a*,82*b* as shown herein connected to the latch bar 84. When the latch 86 is located in its extended position, the latch projections 82*a*,82*b* project/extend into the mouth MF of the front hook FH and obstruct the mount MF sufficiently to prevent the first attachment pin P1 from moving out of (or into) the front hook FH. When the latch 86 is located in its retracted position, the latch projections 82*a*,82*b* are withdrawn from the mouth MF of the front hook FH sufficiently to allow the first attachment pin P1 to move out of (or into) the front hook FH.

Figure 5:
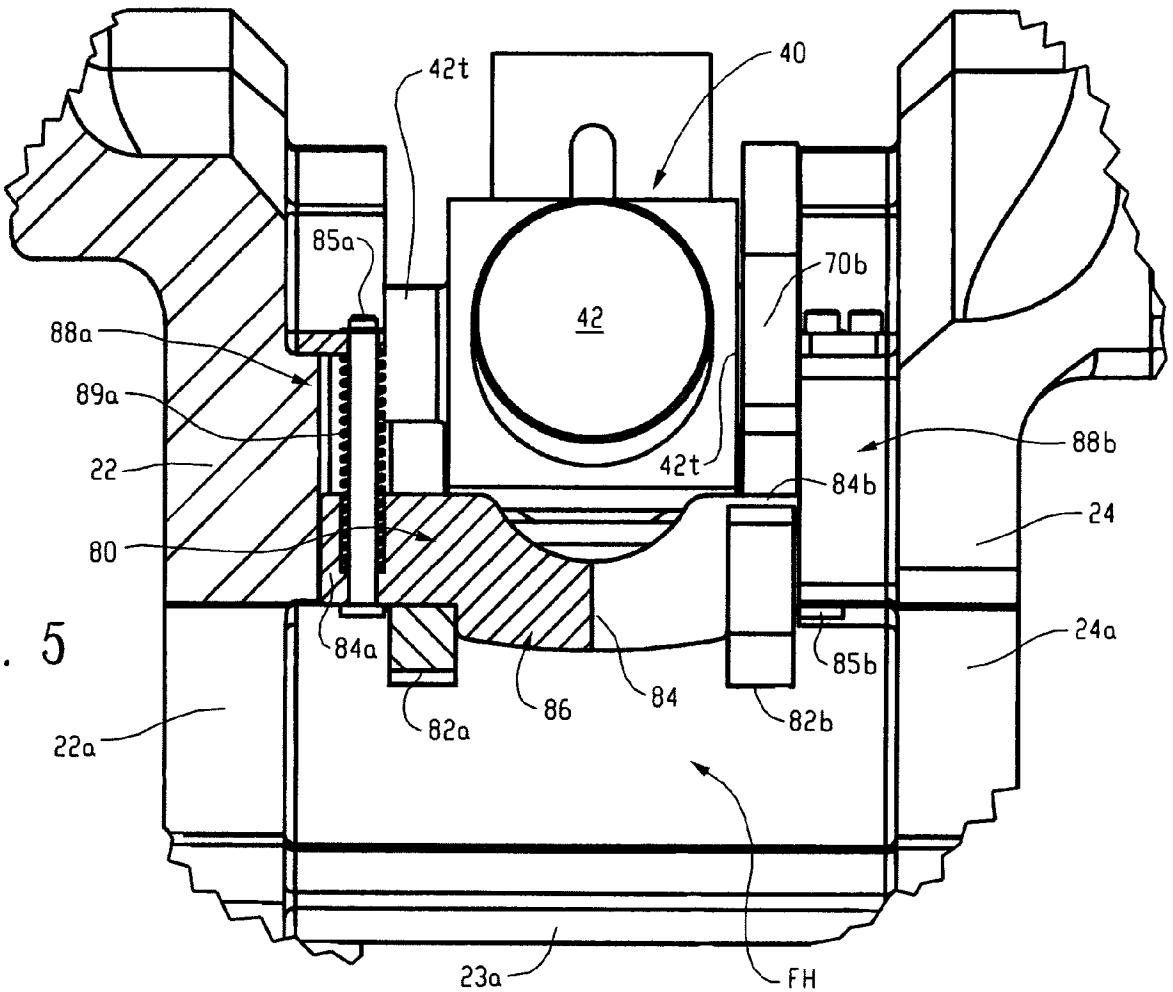
FIG. 5 is a view of the coupler 10 as taken at view line 5-5 of FIG. 3, with certain components removed for clarity.

As can be seen in FIG. 5, the coupler frame F comprises first and second latch bar housings 88*a*,88*b* in which the opposite ends 84*a*,84*b* of the latch bar 84 are respectively located. As shown, the latch bar housings 88*a*,88*b* are connected respectively to the first and second lower plates 22,24 or other part of the coupler frame (the first latch bar housing 88*a* is sectioned to reveal the internal components). The opposite first and second ends 84*a*,84*b* of the latch bar are slidable or otherwise movable in the respective first and second latch bar housings 88*a*,88*b* so that the latch 86 can move to and between its extended and retracted positions. The latch bar housings 88*a*,88*b* include respective first and second latch springs 89*a*,89*b* (see also FIG. 2) that act on the opposite first and second ends of the latch bar 84 to bias the latch 86 to its extended position. In the illustrated example, first and second latch pins 85*a*,85*b* (see FIGS. 2, 3 and 5) are respectively connected to the first and second latch bar ends 84*a*,84*b*, and the first and second latch pins 85*a*,85*b* are slidably connected to the first and second latch bar housings 88*a*,88*b*, respectively. The first and second latch springs 89*a*,89*b* (see FIGS. 2 and 5) are coaxially positioned on said first and second latch pins 85*a*,85*b*. The latch bar 84 moves linearly between its extended and retracted positions, parallel with the first and second latch pins 85*a*,85*b*, by sliding on the pins 85*a*,85*b* and/or by moving with the pins 85*a*,85*b* as they slide relative to the housings 88*a*,88*b*. This simple linear movement of the latch bar 84 as controlled by the parallel first and second latch pins 85*a*,85*b* is deemed preferable to a pivoting latch or other more complex movement for improved reliability and safety in harsh conditions.

The latch 86 is manually movable to its retracted position against the biasing force of the springs 89*a*,89*b*. In particular, except when the secondary lock 80 is in its locked condition as described below, the second attachment pin P2, itself, is used to move the latch 86 from its extended position to its retracted position during movement of the second attachment pin P2 into and out of the front hook FH. The latch projections 82*a*,82*b* each include inner and outer ramp surfaces 81*a*,81*b* that converge to a tip as the ramp surfaces extend away from the latch bar 84 and that are configured so that contact between either the inner or outer ramp surface 81*a*,81*b* and the second attachment pin P2 will urge the latch 86 toward its retracted position (although movement of the latch to its retracted position is not possible unless the secondary lock 80 is in its unlocked configuration). The inner ramp surface 81*a* faces the inner region IF of the front hook FH and the outer ramp surface 81*b* faces away from the inner region IF.

The secondary lock 80 is selectively locked such that the latch 86 is blocked from moving from its extended position to its retracted position if at least one of the lock bars 70*a*,70*b* is in its engaged position. As shown in FIG. 2 and FIG. 7, the lock bars 70*a*,70*b* each include a second lock face 74*f*. When the lock bars 70*a*,70*b* are engaged, the second lock faces 74*f* thereof are located to block movement of the latch 86 from the extended position to the retracted position so that a first attachment pin P1 located in the front hook FH is prevented from moving the latch 86 to its retracted position. Accordingly, when the secondary lock 80 is in the locked condition, a first attachment pin P1 located in the front hook FH is prevented by the latch projections 82*a*,82*b* from exiting the front hook FH. As shown, the respective second lock faces 74*f* of the lock bars 70*a*,70*b* are positioned to engage respective lock faces 83*a*,83*b* of the latch projections 82*a*,82*b* when the lock bars 70*a*,70*b* are engaged in order to block retraction of the latch 86. The lock faces 74*f* can alternatively engage any other part of the latch 86 to block retraction thereof. For each lock bar 70*a*,70*b*, the second lock face 74*f* is located between the pivot axis thereof and the second end 74 so that contact between the latch 86 and the second lock face 74*f* urges the lock bar 70*a*,70*b* toward its engaged position. As is apparent from FIG. 6, when the lock bars 70*a*,70*b* are in their disengaged positions, the latch 86 is able to be moved by the first attachment pin P1 to its retracted position to allow insertion/removal of the first attachment pin P1 relative to the front hook FH. If the coupler 10 includes only a single lock bar 70*a*,70*b*, such single lock bar 70*a*,70*b* will include a second lock face 74*f* adapted to engage the latch 86 when the lock bar 70*a*,70*b* is engaged, to prevent movement of the latch 86 from its extended position to its retracted position.

Figure 5A:
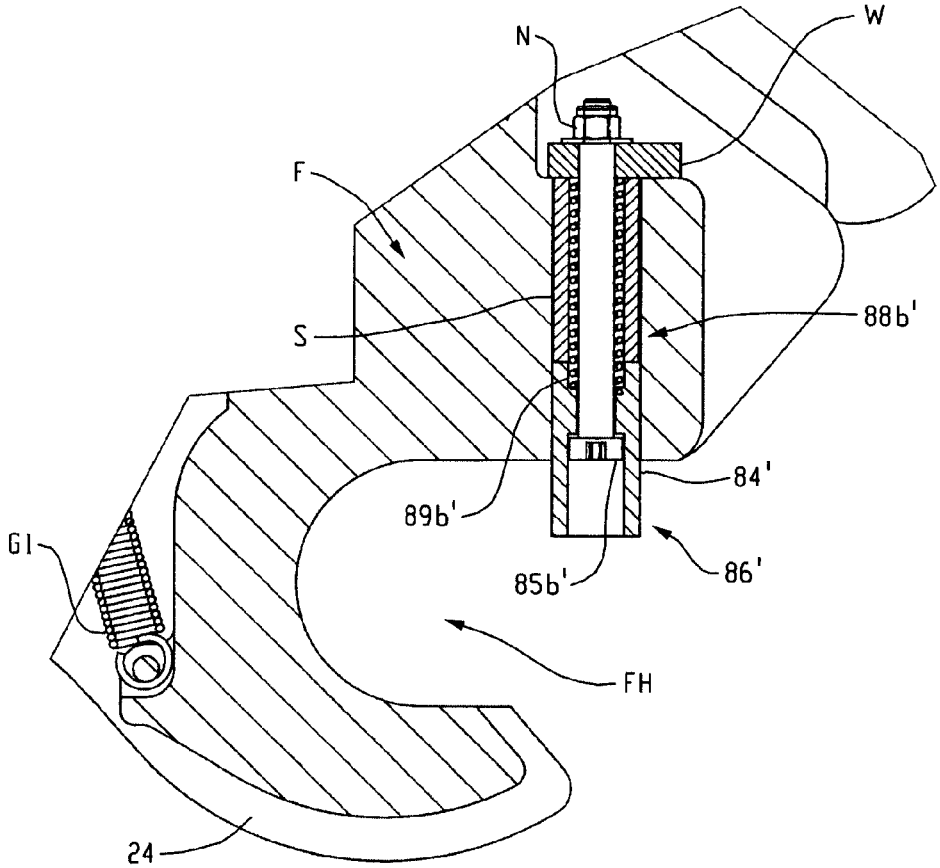
FIG. 5A shows another structure for slidably connecting the latch bar to the coupler frame.

FIG. 5A shows a structure for slidably connecting an alternative latch 86' of a secondary lock to the coupler frame F (like components between the latch 86 and the latch 86' are shown with like reference numbers including a primed (') suffix). Although not shown in FIG. 5A, the latch 86' also includes one or more latch projections connected to the latch bar 84' that are structured the same as the latch projections 82*a*,82*b* described above. An alternative second latch bar housing 88*b'* is connected to and/or defined as part of the frame F (the alternative first latch bar housing 88*a'* has the same structure as shown in FIG. 5A). A shoulder screw 85*b'* acts as the second latch pin and it extends through the latch bar 84' and the housing 88*b'*. A lock nut N and washer W are secured to the shoulder screw 85*b'* to capture the screw to the second latch bar housing 88*b'*. The screw 85*b'* can slide relative to the latch bar housing 88*b'*. Also, the latch bar 84' can slide relative to the shoulder screw 85*b'*. A compression latch spring 89*b'* is coaxially installed about the shoulder screw 85*b'* and acts against the latch bar 84' at one end and the washer W at the other end to bias the latch bar 84' to its extended position (as shown). The latch spring 89*b'* is preferably housed within a protective tube or sleeve S made from Buna N foam or the like. The sleeve S helps to seal the shoulder screw 85*b'*, spring 89*b'*, and sliding interfaces between the latch bar 84' and the shoulder screw 85*b'* from dirt and debris. The structure shown in FIG. 5A is advantageous because the latch bar 84' can slide relative to the shoulder screw 85*b'* between its extended and retracted positions, and/or the shoulder screw 85*b'* can slide relative to the housing 88*b'* to allow the latch bar 84' to move between its extended and retracted positions. As such, reliability is improved, and manufacturing tolerances can be more easily accommodated.

To operatively engage an attachment, the coupler 10 is curled to pivot the lock bars 70*a*,70*b* to their disengaged positions by contact of their outer ends 74 with the excavator arm DS. The rear lock plate 30 is then retracted as shown in FIG. 6. The coupler 10 is them rotated relative to the excavator arm DS to any desired position (the retracted lock plate 30, itself, prevents return movement of the lock bars 70*a*,70*b* to their engaged positions when the coupler is rotated away from the curled position). The front hook FH is first engaged with the first attachment pin P1, which pushes the latch 86 to its retracted position by contact with outer ramp surfaces 81*b* and moves fully into the front hook FH as indicated by arrow A1. The coupler 10 is then again rotated relative to excavator arm DS and about the first attachment pin P1 so that the second attachment pin P2 moves fully into the rear hook RH as indicated by arrow A2. The actuator 40 is then operated to extend the rear lock plate 30 to its locked position as shown in FIG. 7 for use of the coupled attachment. Extension of the rear lock plate 30 to its locked position causes lock bars 70*a*,70*b* to move to their engaged positions via force of springs G1,G2. When the lock bars 70*a*,70*b* are in their engaged positions, their first lock faces 72*f* block movement of the rear lock plate 30 to its retracted/unlocked position and their second lock faces 74*f* block movement of the latch 86 to its retracted position so that the attachment pins P1,P2 are captured in the front and rear hooks FH,RH, respectively. Decoupling of the attachment is accomplished by first curling the coupler 10 until the second ends 74 of lock bars 70*a*,70*b* contact the excavator arm DS causing the lock bars 70*a*,70*b* to move to their disengaged positions. The actuator 40 is then used to move the rear lock plate 30 to its retracted/unlocked position. With the rear lock plate 30 unlocked, the coupler 10 is rotated relative to the excavator arm DS so that the second attachment pin P2 exits rear hook RH (the retracted lock plate 30, itself, prevents return movement of the lock bars 70*a*,70*b* to their engaged positions when the coupler is rotated away from the curled position). Once the second attachment pin P2 is free of the rear hook RH, the coupler 10 is moved (with the attachment supported on the ground or other safe location) so that the first attachment pin P1 is forced from the front hook FH which requires that the first attachment pin P1, itself, urge the latch 86 to its retracted position by contact between the first attachment pin P1 and the inner ramp surfaces 81*a* of the latch projections 82*a*,82*b*.

The coupler 10 can further comprise one or more electrical switches SW1 (FIG. 6) connected to the frame F and adapted to sense the position of the lock plate 30 (or another component) to indicate when the lock plate 30 is (or is not) in its locked position. The switch SW1 can be a contact or non-contact switch, e.g., a reed switch or Hall-effect sensor, located to be tripped when the lock plate 30 moves to/from its locked position. In such case, the lock plate 30 can include a magnet or other component to trip the switch SW1. The switch SW1 outputs an electrical signal that can be used, e.g., by a control system of the excavator, to "numb" or completely disable the excavator in the event the lock plate 30 moves out of its locked position at an unexpected time, i.e., when the coupler 10 is not curled sufficiently relative to the excavator arm DS to prevent dropping of the attachment even if the lock plate 30 is unlocked. Alternatively or additionally, the actuator 40 can include the switch SW1 in or near the actuator 40 so as to sense the position of the rod 44 for the same purpose and result.

Also, the hydraulic cylinder actuator 40 is equipped with a pilot check valve V (FIG. 3) that prevents retraction of the rod 44 into the housing 42 in the absence of sufficient hydraulic fluid pressure being supplied to the retract port of the cylinder 40, i.e., the pilot check valve prevents retraction of the rod 44 simply due to loss of pressure at the extend side of the hydraulic cylinder 40 so that the retract side of the cylinder must be actively pressurized in order for the rod 44 to move the lock plate 30 from its locked position to its unlocked position.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An attachment coupler comprising:

a frame including: (i) an upper portion adapted for connection to an excavator arm and control link; and, (ii) a lower portion including a front hook and rear hook respectively adapted for engaging first and second associated attachment pins of an associated attachment;

a lock plate movable between an unlocked position and a locked position, wherein said lock plate obstructs said rear hook to capture the second associated attachment pin in the rear hook when in said locked position and wherein said lock plate is withdrawn relative to said rear hook to allow movement of the second associated attachment pin into and out of the rear hook when in said unlocked position;

an actuator operably connected to the lock plate for moving the lock plate to and between its unlocked position and its locked position;

a first lock bar connected to the frame and movable between an engaged position and a disengaged position, wherein said first lock bar blocks movement of said lock plate from its locked position to its unlocked position when said first lock bar is in its engaged position;

a secondary lock associated with said front hook, said secondary lock comprising a latch that moves between an extended position and a retracted position, said latch including a latch bar and at least a first latch projection connected to the latch bar, wherein said first latch projection projects into and obstructs said front hook to capture the first associated attachment pin in said front hook when said latch is in its extended position, said first latch projection retracted relative to said front hook to allow movement of the first associated attachment pin into and out of said front hook when said latch is in said retracted position, wherein said secondary lock further comprises: (i) first and second latch bar housings connected to said frame and respectively slidably engaged with opposite first and second ends of the latch bar; and (ii) first and second latch springs located respectively in said first and second latch bar housings and acting respectively on said first and second ends of said latch bar;

wherein said latch is biased to its extended position and movable from its extended position to its retracted position by contact between the latch and the first associated attachment pin when said first lock bar is in its disengaged position; and wherein said first lock bar blocks movement of said latch from its extended position to its retracted position when said first lock bar is in its engaged position.

2. The attachment coupler as set forth in claim 1, wherein:

first and second latch pins are respectively connected to said first and second ends of said latch bar; and, said first and second latch pins are respectively connected to said first and second latch bar housings; and wherein said latch bar is slidable on said first and second latch pins and said first and second latch pins are slidable relative to said first and second latch bar housings.

3. The attachment coupler as set forth in claim 2, wherein said first and second latch springs are coaxially positioned on said first and second latch pins.

4. The attachment coupler as set forth in claim 1, wherein said latch further comprises a second latch projection connected to said latch bar and that projects into and obstructs said front hook to capture the first associated attachment pin in said front hook when said latch is in its extended position, said second latch projection retracted relative to said front hook to allow movement of the first associated attachment pin into and out of said front hook when said latch is in said retracted position.

5. The attachment coupler as set forth in claim 1, wherein said first lock bar comprises:

a first lock face adapted to abut the lock plate and prevent movement of the lock plate from its locked position to its unlocked position when said first lock bar is in its engaged position; and, a second lock face adapted to abut the latch of the secondary lock to prevent movement of the latch from its extended position to its retracted position when said first lock bar is in its engaged position.

6. The attachment coupler as set forth in claim 5, wherein said second lock face is located on said first lock bar such that contact between said second lack face and said latch urges said first lock bar toward its engaged position.

7. The attachment coupler as set forth in claim 1, further comprising:

a second lock bar connected to the frame and movable between an engaged position and a disengaged position, wherein said second lock bar blocks movement of said lock plate from its locked position to its unlocked position when said second lock bar is in its engaged position.

8. The attachment coupler as set forth in claim 7, wherein both said first and second lock bars comprise:

a first lock face adapted to abut the lock plate and prevent movement of the lock plate from its locked position to its unlocked position when said first and second first lock bars are in the engaged position; and, a second lock face adapted to abut the latch of the secondary lock to prevent movement of the latch from its extended position to its retracted position when said first and second lock bars are in the engaged position.

9. The attachment coupler as set forth in claim 1, wherein:

said frame upper portion comprises first and second spaced-apart upper ribs;

said frame lower portion comprises first and second spaced-apart lower ribs that are connected respectively to said first and second upper ribs;

said first and second lower ribs respectively comprise first and second inner slots located on an inner side of an open mouth of said rear hook and first and second outer slots located on an outer side of said open mouth of said rear hook;

said lock plate is slidably supported in said first and second inner slots and extends across said open mouth and into the first and second outer slots when said lock plate is in its locked position.

10. The attachment coupler as set forth in claim 1, wherein said first latch projection comprises first and second ramp surfaces that converge toward each other, wherein contact between the associated first attachment pin and either the first or second ramp surface urges the latch toward its retracted position.

11. A coupler comprising:

a frame including a front hook and a rear hook;

a rear hook lock that moves between an unlocked position and a locked position, wherein said rear hook lock obstructs an open mouth of the rear hook when said rear hook lock is in its locked position;

an actuator connected to said frame and operatively connected to said rear hook lock, said actuator adapted to move said rear hook lock between its unlocked and locked positions;

a secondary lock comprising a latch that moves between extended and retracted positions, wherein said latch obstructs an open mouth of said front hook when said latch is in its extended position;

a first lock bar connected to said frame, said first lock bar movable between an engaged position and a disengaged position, said first lock bar comprising: (i) a first lock face that blocks movement of said rear hook lock from its locked position to its unlocked position when said first lock bar is in its engaged position; and, (ii) a second lock face that blocks movement of said latch of said secondary lock from its extended position to its retracted position when said first lock bar is in its engaged position, said first lock bar biased toward its engaged position and adapted to be moved to its disengaged position by relative movement between said frame and an associated arm to which said frame is connected sufficient to cause a projecting end of said first lock bar to contact the associated arm;

a second lock bar connected to said frame, said second lock bar movable between an engaged position and a disengaged position, said second lock bar comprising: (i) a first lock face that blocks movement of said rear hook lock from its locked position to its unlocked position when said second lock bar is in its engaged position; and, (ii) a second lock face that blocks movement of said latch of said secondary lock from its extended position to its retracted position when said second lock bar is in its engaged position, said second lock bar biased toward its engaged position and adapted to be moved to its disengaged position by relative movement between said frame and the associated arm to which said frame is connected sufficient to cause a projecting end of said second lock bar to contact the associated arm; and, a first lock bar spring connected between the first lock bar and the frame, and a second lock bar spring connected between the second lock bar and the frame, said first and second lock bar springs respectively biasing said first and second lock bars to their engaged positions.

12. The coupler as set forth in claim 11, further comprising at least one latch spring that biases said latch to said extended position.

13. A coupler comprising:

a frame including a front hook and a rear hook;

a rear hook lock that moves between an unlocked position and a locked position, wherein said rear hook lock obstructs an open mouth of the rear hook when said rear hook lock is in its locked position;

an actuator connected to said frame and operatively connected to said rear hook lock, said actuator adapted to move said rear hook lock between its unlocked and locked positions;

a secondary lock comprising a latch that moves between extended and retracted positions, wherein said latch obstructs an open mouth of said front hook when said latch is in its extended position;

a first lock bar connected to said frame, said first lock bar movable between an engaged position and a disengaged position, said first lock bar comprising: (i) a first lock face that blocks movement of said rear hook lock from its locked position to its unlocked position when said first lock bar is in its engaged position; and, (ii) a second lock face that blocks movement of said latch of said secondary lock from its extended position to its retracted position when said first lock bar is in its engaged position;

said first lock bar biased toward its engaged position and adapted to be moved to its disengaged position by relative movement between said frame and an associated arm to which said frame is connected sufficient to cause a projecting end of said first lock bar to contact the associated arm;

at least one latch spring that biases said latch to said extended position.

14. The coupler as set forth in claim 13, wherein said latch comprises:

a latch bar; and, at least a first latch projection connected to said latch bar, wherein said first latch projection obstructs said open mouth of said front hook when said latch is in its extended position.

15. The coupler as set forth in claim 14, wherein said first latch projection comprises:

first and second ramp surfaces that converge toward each other to define a tip of said first latch projection, wherein said first ramp surface faces toward an inner region of said front hook and said second ramp surface faces away from said inner region of said front hook.

* * * * *